US005853095A

United States Patent [19]

Marshall et al.

[11] Patent Number: 5,853,095

[45] Date of Patent: Dec. 29, 1998

[54] TAMPER EVIDENT SPLITTING CLOSURE

[75] Inventors: F. Paul Marshall, Orland Park; Douglas G. Begley, Palatine, both of Ill.

[73] Assignee: White Cap, Inc., Downers Grove, Ill.

[21] Appl. No.: 644,716

[22] Filed: May 10, 1996

Related U.S. Application Data

[63] Continuation of Ser. No. 217,224, Mar. 24, 1994, abandoned, which is a continuation of Ser. No. 993,085, Dec. 18, 1992, abandoned.

[51] Int. Cl.[6] ..... B65D 41/34

[52] U.S. Cl. ..... 215/252; 215/901

[58] Field of Search ..... 215/252, 256, 215/258, 901

[56] References Cited

U.S. PATENT DOCUMENTS

| | | | |
|---|---|---|---|
| 4,305,516 | 12/1981 | Perne et al. | 215/252 |
| 4,394,918 | 7/1983 | Grussen | 215/243 |
| 4,418,828 | 12/1983 | Wilde et al. . | |
| 4,458,821 | 7/1984 | Ostrowsky . | |
| 4,458,822 | 7/1984 | Ostrowsky | 215/252 |
| 4,511,053 | 4/1985 | Brandes et al. . | |
| 4,530,436 | 7/1985 | Wiedmer . | |
| 4,545,496 | 10/1985 | Wilde et al. | 215/252 |
| 4,550,843 | 11/1985 | Nolan . | |
| 4,565,295 | 1/1986 | Mori et al. | 215/252 |
| 4,666,053 | 5/1987 | Corcoran et al. . | |
| 4,720,018 | 1/1988 | Schetzsle et al. | 215/252 |
| 4,744,479 | 5/1988 | Schöttli | 215/252 |
| 4,796,770 | 1/1989 | Begley | 215/252 |
| 4,913,300 | 4/1990 | Wiedmer et al. . | |
| 5,040,692 | 8/1991 | Julian . | |
| 5,056,675 | 10/1991 | Julian | 215/252 |
| 5,080,246 | 1/1992 | Hayes | 215/252 |
| 5,129,530 | 7/1992 | Fuchs | 215/252 |

*Primary Examiner*—Allan N. Shoap
*Assistant Examiner*—Nathan Newhouse
*Attorney, Agent, or Firm*—Lockwood, Alex, FitzGibbon & Cummings

[57] ABSTRACT

A tamper evident closure for sealing a container having a threaded neck portion and an outwardly extending annular flange below the threaded neck portion including a cap assembly having an annular skirt and an annular tamper band assembly having a top edge connected to the annular skirt by a plurality of frangible bridges disposed about a first portion of the annular tamper band, at least one infrangible bridge disposed about a second portion of the annular tamper band and a vertically weakened section between the first and second portion and a series of interconnected hinged engagement tabs disposed along the first portion of the annular tamper band.

12 Claims, 2 Drawing Sheets

TAMPER EVIDENT SPLITTING CLOSURE

This application is a continuation of application Ser. No. 08/217,224, filed Mar. 24, 1994, now abandoned, which is a continuation of application Ser. No. 07/993,085, filed Dec. 18, 1992, now abandoned.

The present invention relates in general to new and useful improvements in closures and, particularly, to a screw-type closure having an improved integrally formed tamper indicating band. In this regard, an important aspect of the present invention concerns a threaded plastic closure having an improved tamper indicating band attached thereto by a plurality of frangible bridges and a tether or thickened bridge wherein the band is provided with vertical grooves that permit it to split into one or more segments.

BACKGROUND OF THE INVENTION

The utilization of tamper indicating closures has become widely accepted in the packaging of consumer goods, particularly in readily accessible food products intended for human consumption such as beverages. Such utilization has become almost mandatory upon food product suppliers to insure consumer confidence in the integrity of the product and to instill a sense of quality. A common method employed with respect to containers such as bottles is the use of a ring or band connected to the closure which is severed from the closure upon initial removal of the closure from the container. The separation between the closure and the band is visible thus indicating to the consumer prior usage.

Closures having separable tamper bands are generally employed on containers having a threaded neck portion and an outwardly extending annular flange below the neck portion. In one such type of tamper indicating closure shown for example in U.S. Pat. Nos. 4,458,821, and 4,458,822, the closure includes a top wall and an annular downwardly depending sidewall. The tamper indicating band or ring is connected to the lower end of the annular sidewall by a plurality of frangible bridges and one non-frangible bridge. The band also includes a vertically weakened area which extends across its width and which is generally diametrically opposite the non-frangible area and which fractures upon initial removal of the closure. The band is also provided with a series of interconnected hinged tabs disposed about the lower end of the band for engaging the annular flange on the container neck.

When the aforedescribed closure, which includes a threaded portion on the inner surface of the sidewall, is unscrewed from the container, the hinged tabs engage the annular bead or flange on the container neck halting the upward movement of the tamper band and thereby stretching the frangible bridges and the vertical frangible portion until they break. One drawback associated with this type of closure is that it relies solely on stretching to break the vertically weakened area, thus a longer thread portion on the neck of the container is required to use up all the clearance space and split the band. Because of the extra clearance space required, this method requires additional relatively expensive material in the annular sidewall and requires more effort on the user's part by way of additional unscrewing of the closure to break the band.

SUMMARY OF THE INVENTION

In accordance with the present invention, a tamper indicating splitting band for a container is disclosed. In the preferred embodiment the closure is adapted for use on a container having a threaded neck portion and an outwardly extending annular flange disposed below the threaded neck portion.

The closure includes a cap assembly having a top wall and an annular skirt depending from the periphery of the top wall so that the skirt and the top wall are substantially coaxial. The skirt includes an integral thread on its inner surface for cooperation with the threaded neck portion of the container to allow attachment and removal of the cap assembly to the container by relative rotation therebetween.

The closure of the present invention further includes a tamper band assembly including an annular member having a top and bottom edge connected about a first portion of the annular member to the annular skirt by a plurality of frangible bridges. The tamper band assembly further includes an infrangible bridge connecting a second portion of the annular member to the annular skirt. A vertically weakened split line is provided between the first and second portions of the annular member. Additionally, a plurality of engagement tabs are hingedly connected to the first portion of the annular member and are adapted to engage the annular flange on the container.

Rotation of the closure relative to the container causes the thread on the closure and container to cooperate raising the cap assembly and the second portion of the tamper band assembly relative to the container. The hinged engagement tabs abut against the annular flange of the container restricting the upward movement of the first portion of the ring segment causing the frangible bridges to break and the vertically weakened split line of the ring segment to sever. With the vertically weakened split line severed, first use is obvious and the cap assembly and tamper band assembly are removed from the container through continued rotation of the closure.

BRIEF DESCRIPTION OF THE DRAWINGS

For a more complete understanding of the present invention reference should now be made to the embodiment illustrated in greater detail in the accompanying drawings and described below by way of example of the invention. It should be understood that the invention Is not necessarily limited to the particular embodiment illustrated herein, but is defined by the appended claims.

In The Drawings

DETAILED DESCRIPTION OF THE PREFERRED EMBODIMENT

Figure 1:
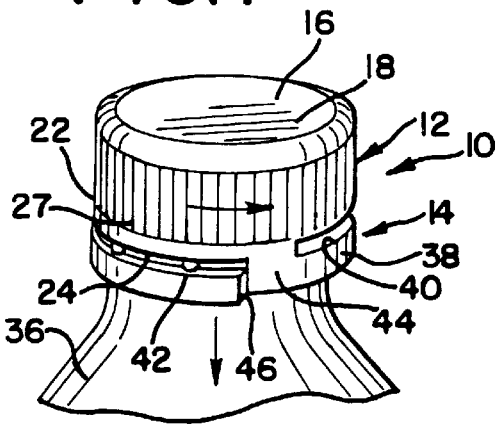
FIG. 1 is a top perspective view of a closure according to the present invention.

Referring to the drawings, a tamper evident splitting closure according to the present invention is generally indicated by the reference numeral 10. The tamper evident splitting closure 10 is provided with a cap assembly 12 and a tamper band assembly 14.

Figure 4:
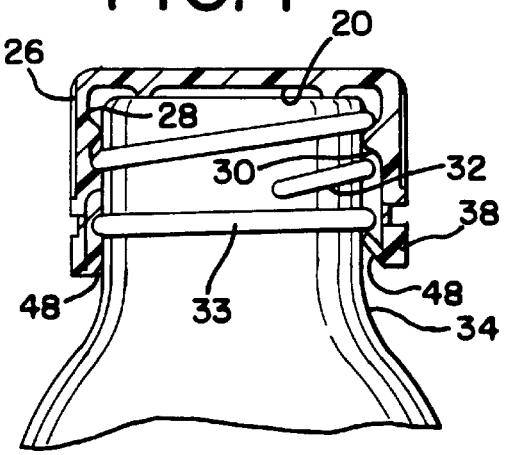
FIG. 4 is a side sectioned view of the closure of FIG. 1.
Figure 2:
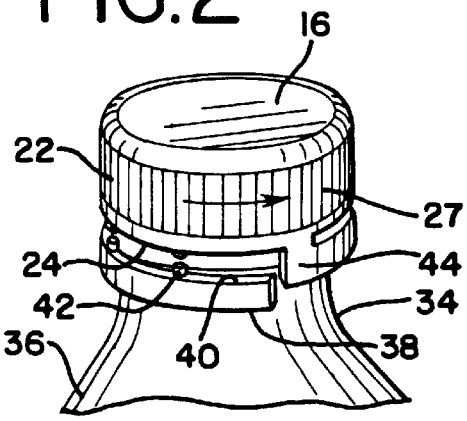
FIG. 2 is a top perspective view of the closure of FIG. 1 illustrating initial removal of the closure from the container.

The cap assembly 12 includes a top wall 16 having a top surface 18 and a bottom surface 20. An integral annular skirt 22 depends from the top wall 16 and has a free end 24 extending away from the periphery of the top wall 16 so that the annular skirt 22 is substantially coaxial with the top wall 16. As shown in FIG. 4, the skirt 22 has an outer surface 26 and an inner surface 28. The inner surface 28 includes an integral helical thread 30 and the outer surface 26 preferably includes a series of radially extending ribs 27 to enhance the user's grip on the cap assembly 12.

The closure is intended for use on a container 36 such as a bottle that has a neck portion and a thread 32 disposed on the neck 34. Additionally, the container is provided with an annular abutment flange 33 disposed below the thread 32. The integral thread 30 on the inner surface 28 of the annular skirt is adapted to cooperate with the thread 32 on the neck 34 of the container 36 as shown in FIG. 4, for securing the closure 10 to the container 36. The cap assembly 12 may include sealing means such as a gasket or hot melt disposed on the bottom surface 20 of the top wall 16, the application of which is well known in the art. The cap assembly 12 can be made of any suitable plastic such as polyethylene or polypropylene with polypropylene usually being preferred.

In accordance with the present invention, the tamper band assembly 14 includes a closed ring 38 coaxial with the cap assembly 12. A plurality on frangible bridges 42 disposed about a first portion of the closed ring 38 along the upper edge 40 connect the closed ring to the free end 24 of the annular skirt 22. Additionally, a second portion of the closed ring 38 is connected to the free end 24 of the cap annular skirt 22 by a single thickened bridge or tether 44 that is substantially infrangible.

The closed ring 38 additionally includes a weakened vertical split line 46 extending across the width of the closed ring from the upper edge 40 to the bottom edge 54. The vertical split line 46 is disposed between the first and second portions of the closed ring 38 and is adjacent one side of the tether 44. The vertically weakened split line 46 is severed during removal of the closure 10 from the container to indicate that the closure 10 has previously been removed.

Figure 5:
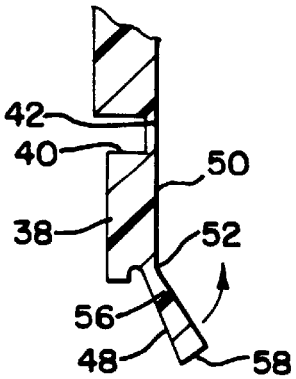
FIG. 5 is a partial view illustrating the hinged engagement tab as initially molded.

As shown in FIG. 5–8, the closed ring 38 also includes a series of connected hinged engagement tabs 48 connected at one end 52 to the lower edge of inner surface 50 of the closed ring 38. The hinged tabs 48 are flexibly connected at one end 52 to the lower edge 54 of the closed ring 38 to form an annular hinge 56. The hinged tabs 48 include a free end 58 that protrudes inwardly and upwardly from the closed ring 38 for engaging in annular abutment flange 33 on the neck 34 of the container 36 when the closure 10 is seated on the container 36. It should be noted that the tabs are originally molded in the position as shown in FIG. 5 for efficiency reasons, and then prior to the closure 10 being applied to the container are moved about hinge 56 to the position shown in FIG. 6.

In accordance with the present invention, the hinged engagement tabs 48 are preferably distributed only between 180° to 300° around the inner surface 50 of the closed ring 38 starting at a point adjacent the vertical split line 46. An important feature of the present invention is that the hinged tabs 48 are preferably only connected to the first portion of the closed ring 38 along the lower edge 54. Additionally, the frangible bridges 42 are also only connected to the first portion of the closed ring 38 along the upper edge 40. This arrangement of the tabs 48 and the frangible bridges 42 insures a downward force on the first portion of the closed ring 38 attached to the cap assembly 12 by frangible bridges 42 and an upward force supplied by the upward movement of the cap assembly 12 during removal of the second portion of the closed ring 38 supported by the tether 44. As a result, the present invention applies vertically opposite or shearing forces on either side of the vertical split line 46 to easily fracture the closed ring 38 along the vertical split line 46. Maximum shearing action is obtained by eliminating hinged tabs 48 in the approximate one-third section or second portion of the closed ring 38 on the tether side of the vertical split line 46. As a result of the increased shearing forces, the finish or threaded portion 30 of the cap assembly 12 can be shorter vertically to save on material and improve ease of use by requiring fewer turns of the cap assembly 12.

Figure 11:
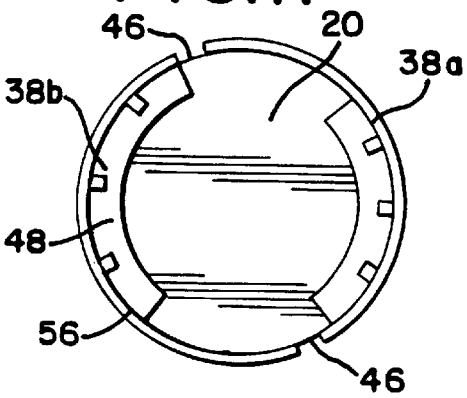
FIG. 11 is a bottom view of an alternative embodiment of the present invention illustrating two ring segments.
Figure 12:
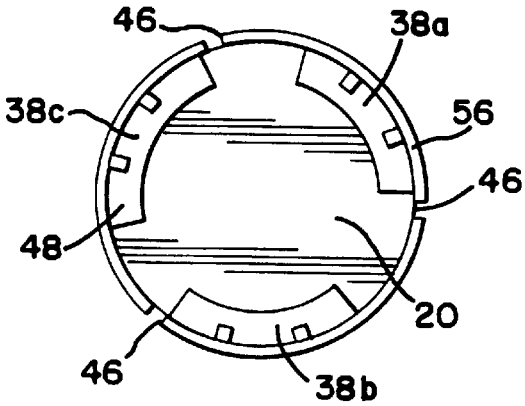
FIG. 12 is a bottom view of an alternative embodiment of the present invention illustrating three ring segments.

It should be understood that in alternative embodiments it may be desirable for the closed ring 38 to have more than one vertical split line 46. For example, in the alternative embodiments shown in FIGS. 11 and 12, the closure 10 may have any number of vertical split lines 46 and corresponding ring segments 38*a*, 38*b*, 38*c* and tethers 44. In each embodiment, the ring segments, in order to maximize shearing at the vertical split line 46, should have hinged tabs on approximately two-thirds of each segment. In some applications it may be preferred that the closure 10 have two vertical split lines 46 as shown in FIG. 11 thereby making splitting of the closed ring 38 more obvious because the consumer or end user is not required to pick up the container 36 and turn it around in order to examine the vertical split line 46 to determine if it has fractured.

It should be understood that the re is it minimum effective length for a ring segment in any given application, but generally, larger diameter closures can afford to use multiple ring segments, while very small diameter closures 10 may only require a single ring segment.

Another important feature of the present invention is that the tether 44 does not fracture during removal of the closure 10, thereby maintaining the integrity of the cap assembly and the tamper band assembly 14. This is accomplished by radially molding the tether 44 thicker than the frangible bridges 42.

Figure 6:
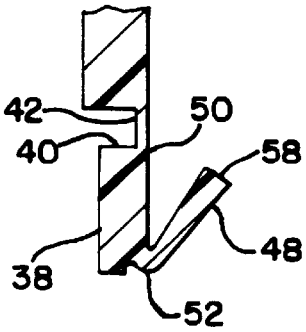
FIG. 6 is a partial view of the hinged engagement tabs according to the present invention illustrating the tabs in their upwardly extending position.

The closure 10 is intended to be placed over the opening 37 of the container 36. With the hinged tabs free end 58 protruding upwardly and inwardly, the closure is placed over the opening on the neck 34 of the container 36. It should be noted that when originally molded, the hinged tabs 48 protrude in a downward orientation as shown in FIG. 5, but because of the flexible hinge connection 56, they are easily repositioned in an upward direction as shown in FIG. 6 prior to attachment of the closure 10 to the container 36.

Figure 7:
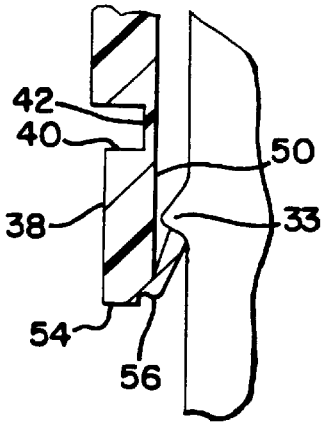
FIG. 7 is a partial view of the hinged engagement tabs according to the present invention engaging the annular flange of the container.

The tamper band assembly 14 and hinged tabs 48 are slid over the thread 32 of the container 36 until the thread 32 of the container initially engages the helical thread 30 on the inner surface 28 of the annular skirt 22 of the cap assembly 12. The closure 10 is then rotated relative to the container 36 securing the closure 10 to the container 36 by the cooperation of the threads 30, 32 while the hinged tabs 48 are bent to a near vertical position while passing over the annular flange 33 on the neck 34 of the container 36. When the closure 10 is completely secured to the container 36, the tamper band assembly 14 is seated below the annular flange 33 of the container 36 while the free ends 58 of the hinged tabs 48 engage the underside of the annular flange 33 and the container neck 34 as shown in FIGS. 4, 7. The compression and shearing forces exerted on the frangible bridges 42 and vertical split line 46 during the original placement of the closure 10 on the container 36 are not significant enough to fracture either, and the tamper band assembly 14 remains connected to the free end 24 of the annular skirt 22.

Referring to FIGS. 1–3, 7, 8, when the closure 10 is initially unscrewed from the container 36, the hinged engagement tabs 48 temporarily lock the first portion of the closed ring 38 under the annular flange 33 of the container 36 while the cap assembly 12 continues to rise due to the cooperation of threads 32, 30 pulling the second portion of the closed ring 38 upwardly at the tether 44, causing shearing forces to act at the vertical split line 46 and fracture both the vertical split line 46 and the frangible bridges 42. Continued unscrewing of the closure 10 disengages the cooperating threads 30, 32 and the closure 10 is easily removed from the container 36.

Figure 3:
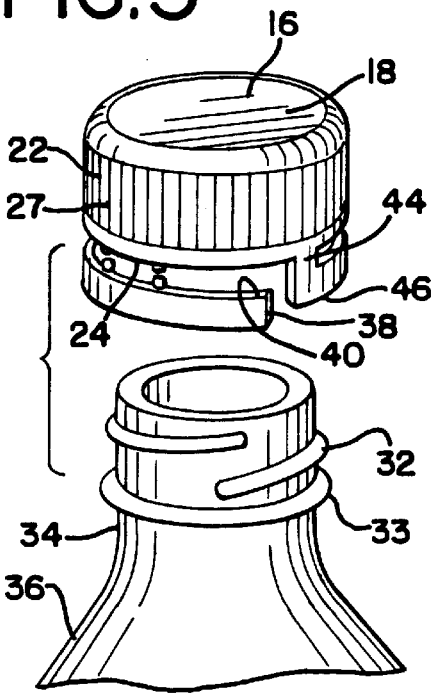
FIG. 3 is a top perspective view of the closure of FIG. 1 illustrating complete removal of the closure from the container.
Figure 8:
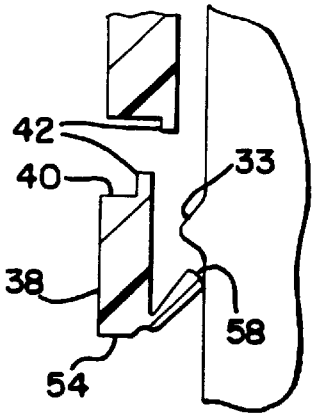
FIG. 8 is a partial view of the hinged engagement tabs according to the present invention illustrating the tabs position during initial removal of the closure.
Figure 9:
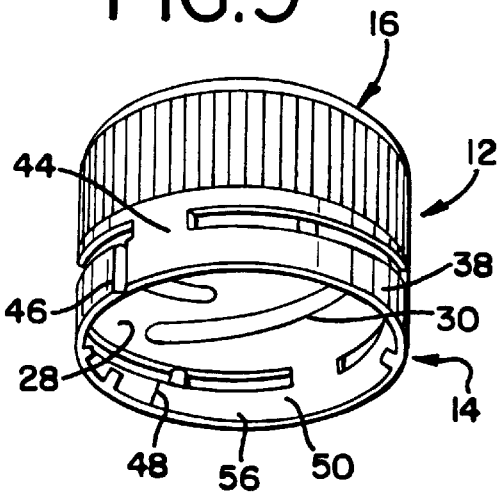
FIG. 9 is a bottom perspective view of an alternative embodiment according to the present invention illustrating a tamper band assembly with two ring segments.
Figure 10:
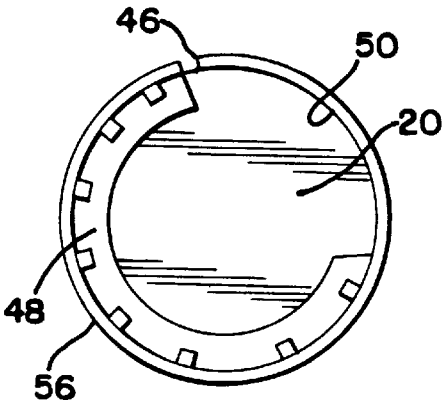
FIG. 10 is a bottom view of a closure according to the present invention.

When the closure 10 is completely removed from the container, the tether 44 which was distorted during the initial removal, pushes the closed ring 38 outwardly and downwardly from the now fractured vertical split line 46 as shown in FIGS. 3 and 8. The closure 10 can then be easily reapplied to the container 36 as the tamper band assembly 14 is connected to the cap assembly 12 at only one point, the tether 44, and will not interfere with reapplication. When reapplied, first use is obvious due to the fractured vertical split line 46 and the outwardly and downwardly extending ring 38.

Although the present invention has been described in connection with a preferred embodiment thereof, many variations and modifications will now become apparent to those skilled in the art. It is preferred therefore, that the present invention be limited not by the specific disclosure herein, but only by the appended claims.

What is claimed is:

1. A tamper evident closure for sealing a container having a threaded neck portion and an outwardly extending annular flange adjacent to and below the threaded neck portion, said tamper evident closure comprising:

a cap assembly having a top wall and an annular skirt, said skirt depending from said top wall so that said skirt and said top wall are substantially coaxial, said skirt having an inner and outer surface and an integral thread disposed on the inner surface of said skirt for cooperation with the threaded neck portion of the container enabling said top wall and said skirt to be secured to and removed from said container by relative rotation therebetween;

a tamper hand assembly including an annular member having a top edge and a bottom edge, said annular member connected along its top edge to said annular skirt by a plurality of frangible bridges disposed about a first circumferential portion of said annular member and at least one infrangible bridge disposed about a second circumferential portion of said annular member, said annular member having a vertically weakened section between said first and second circumferential portions of said annular member, and a series of connected engagement tabs disposed exclusively about said first circumferential portion of said annular member on only one side of the section of said annular member immediately adjacent said vertically weakened section.

2. The invention as in claim 1 wherein said engagement tabs include a first end and a second end wherein said first end is flexibly connected to said bottom edge of said annular member forming a flexible hinge member wherein said second end may he rotated between a downwardly extending as molded position and an upwardly and inwardly extending engagement position.

3. The invention of claim 2 wherein said second end of said engagement tabs disposed in the engagement position engage the annular flange of the container when said closure is in its initial sealed position on said container to restrict upward movement of said first circumferential portion of said annular member during removal of said closure.

4. The invention of claim 1 wherein said vertically weakened section is fractured by shearing forces during removal of said closure.

5. The invention of claim 1 wherein said first circumferential portion constitutes only between 180° to 300° of said annular member immediately adjacent said one side of said vertically weakened section.

6. A tamper evident closure for sealing a container having a threaded neck portion and an outwardly extending annular flange adjacent to and below the threaded neck portion, said tamper evident closure comprising:

a cap assembly having a top wall and an annular skirt depending from the periphery of said top wall so that said skirt and top wall are substantially coaxial, said skirt having an inner and outer surface and integral threads disposed on the inner surface of said skirt for cooperation with the threaded neck portion of the container enabling said top wall and said skirt to be secured to and removed from said container by relative rotation therebetween, a tamper band assembly having at least one ring segment, each said ring segment including: an upper edge and a lower edge, a plurality of frangible bridges disposed exclusively on a first section of said ring segment along said upper edge connecting said first section of said ring segment to said cap assembly, an infrangible connection disposed exclusively on a second section of said ring segment along said upper edge connecting said second section of said ring segment to said cap assembly, a vertically weakened section of said ring segment disposed between said first and second sections of said ring segment, and a plurality of engagement tabs disposed immediately adjacent one side of said vertically weakened section exclusively on said first section of said ring segment.

7. The invention of claim 6 wherein said engagement tabs include a first end and a second end wherein said first end is flexibly connected to said first section of said ring segment along the lower edge forming a flexible hinge member wherein said second end may be rotated between downwardly extending as molded position and an upwardly and inwardly extending engagement position.

8. The invention of claim 7 wherein said second end of said engagement tabs when disposed in the engagement position engage the annular flange of said container when said closure is in its initial sealed position on the container to restrict upward movement of said first section of said ring segment during removal of said closure.

9. The invention of claim 6 wherein said plurality of engagement tabs are connected.

10. The invention of claim 6 wherein said engagement tabs and said frangible bridges are disposed exclusively over said first section of each said ring segment.

11. The invention of claim 6 wherein said first section is immediately adjacent one side of said vertically weakened section and constitutes approximately two-thirds of each said ring segment.

12. The invention of claim 6 wherein said second section is immediately adjacent said vertically weakened section opposite said one side and constitutes approximately one-third of each said ring segment.

* * * * *